US005937491A

United States Patent [19]

Chih

[11] Patent Number: 5,937,491

[45] Date of Patent: Aug. 17, 1999

[54] METAL HANGER RING

[75] Inventor: Chen Wei Chih, Taichung Hsien, Taiwan

[73] Assignee: Yung Ta Hardware & Plastic Co., Ltd., Taichung Hsien, Taiwan

[21] Appl. No.: 09/138,264

[22] Filed: Aug. 21, 1998

[51] Int. Cl.[6] ..... A44B 13/00; F16G 11/00

[52] U.S. Cl. ..... 24/700; 24/256 H; 24/300

[58] Field of Search ..... 24/700, 701, 588, 24/300, 301, 3.13, 265 R, 265 AL, 265 EE, 265 H, 265 C, 265 EC

[56] References Cited

U.S. PATENT DOCUMENTS

| | | | |
|---|---|---|---|
| 2,260,778 | 10/1941 | Hodge | 24/701 |
| 3,962,775 | 6/1976 | Buschini et al. | 24/700 |
| 4,345,732 | 8/1982 | Gallegos | 248/441 B |
| 4,559,677 | 12/1985 | Tracy | 24/700 |
| 4,861,070 | 8/1989 | Boag | 24/265 AL |
| 5,548,875 | 8/1996 | Hart et al. | 24/265 H |
| 5,638,584 | 6/1997 | De Anfrasio | 24/265 H |

FOREIGN PATENT DOCUMENTS

| | | | |
|---|---|---|---|
| 0050069 | 9/1911 | Austria | 24/588 |

*Primary Examiner*—Victor N. Sakran
*Attorney, Agent, or Firm*—Harrison & Egbert

[57] ABSTRACT

An improvement metal hanger ring is composed of a metal hanger ring that is formed a long hole at one end thereof for providing the band can be fixed on, and further formed a support hook at other end thereof. Located center of the support hook is provided with a ring hole. At the upper and bottom end of said support hook around the side of the ring hole has provided with a plastic jacket for avoiding the metal is rubbed and the electroplate is destroyed while the hook is hanging on the ring hole of said metal hanger ring.

6 Claims, 4 Drawing Sheets

METAL HANGER RING

FIELD OF THE INVENTION

The present invention relates generally to a hanger, and more particularly to an improvement to a metal hanger ring.

BACKGROUND OF THE INVENTION

As shown in FIG. 1, the conventional metal hanger ring 10 is connected directly with the hook 12 at one end of the hole 11. Therefore, while using the hanger ring 10 and the hook 12 on the handbag or suitcase, that is easy to happen friction between them due to the metal materials in them. Moreover, the good appearance of the hanger ring 10 and the hook 12 will be destroyed, and so will the electroplating of the metal surface.

Such a prior art metal hanger ring as described above is defective in design in that the goods can become rusty and deformed.

SUMMARY OF THE INVENTION

The primary objective of the present invention is therefore to provide an improvement to a metal hanger ring, which is provided with a special plastic jacket, so as to avoid rubbing of the metal and the destruction of the electroplating while in use.

The objective, features and functions of the present invention will be readily understood upon a thoughtful deliberation of the following detailed description of the present invention with reference to the accompanying drawings.

DETAILED DESCRIPTION OF THE INVENTION

Figure 1:
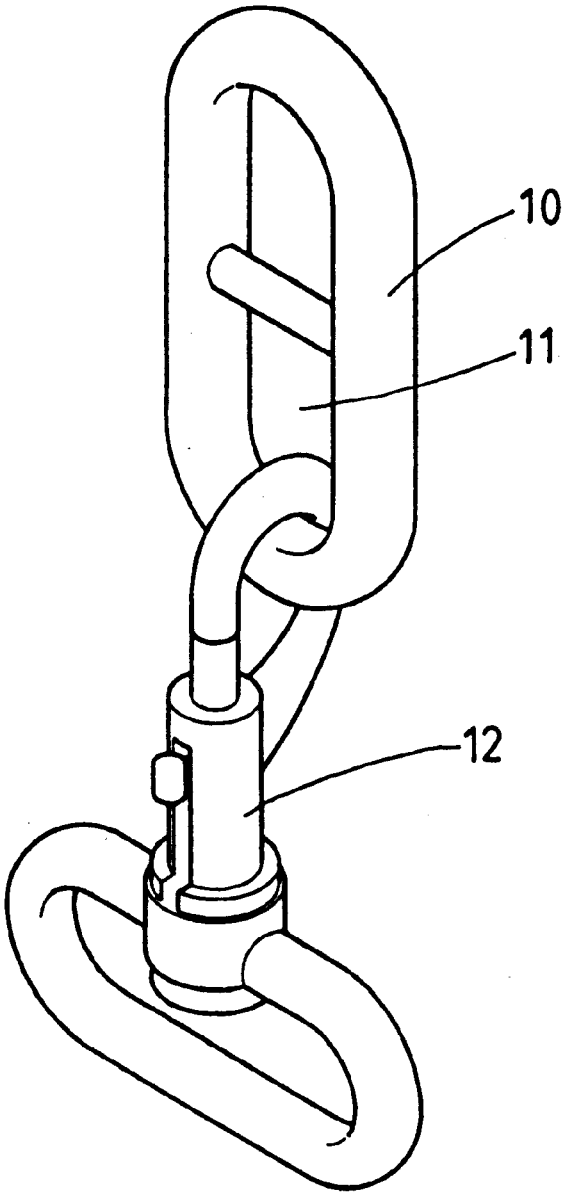
FIG.1 PRIOR ART
FIG. 1 shows a perspective view of the prior art metal hanger ring in combination.
Figure 2:
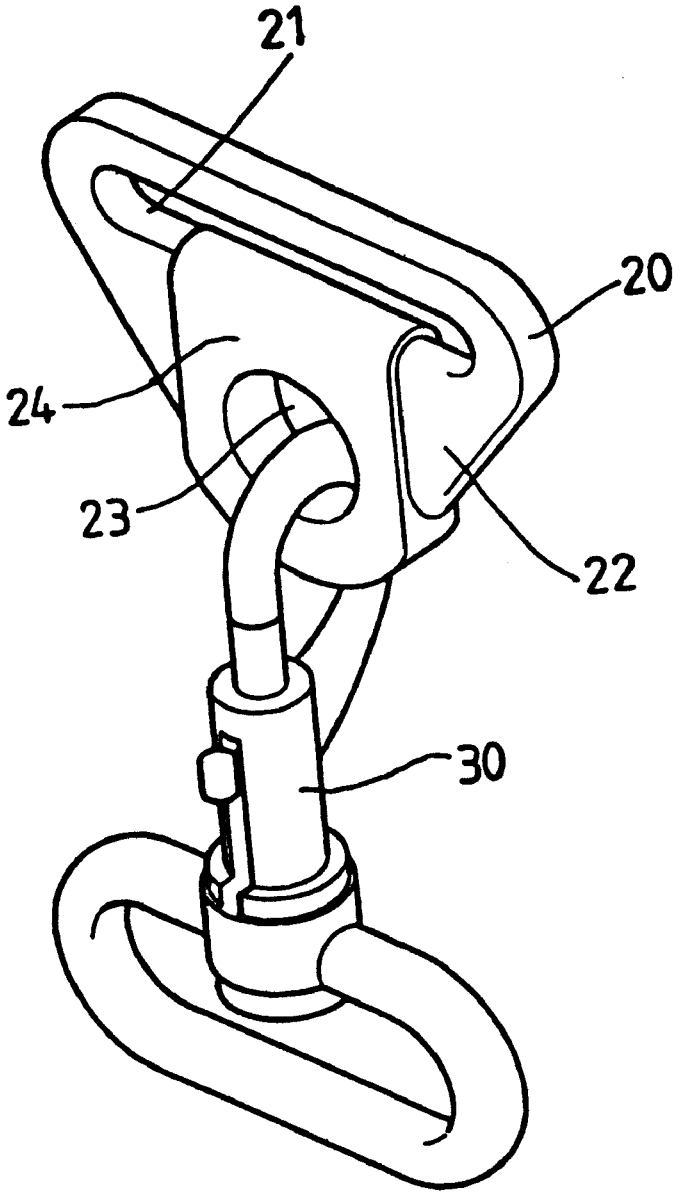
FIG. 2 shows a perspective view of the present invention in combination.
Figure 3:
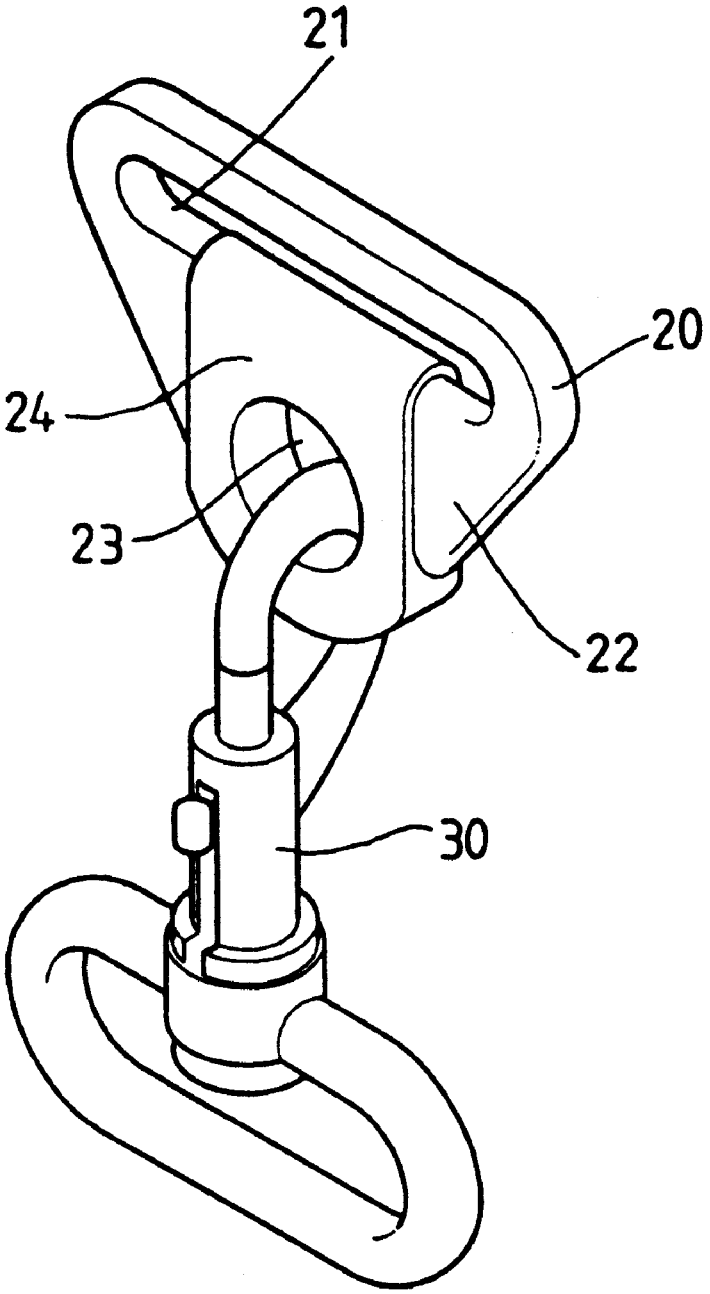
FIG. 3 shows an exploded view of the present invention.
Figure 4:
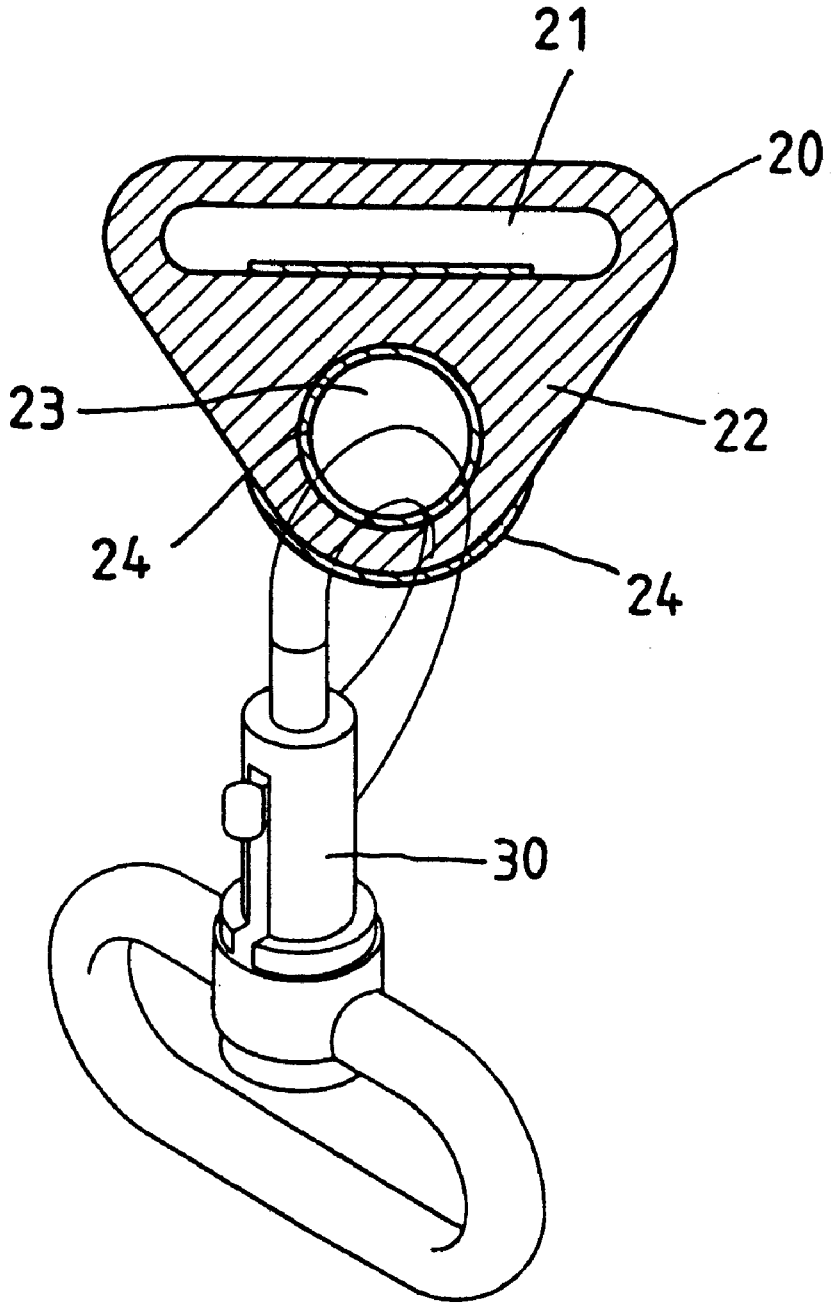
FIG. 4 shows a sectional view of the present invention in combination.

As shown in FIGS. 2, 3 and 4, the metal hanger ring 20 is formed with an elongated hole 21 at one end thereof for providing an area for receiving strap therein, and further formed with a support hook 22 at another end thereof. Located center of the support hook 22 is a ring hole 23. At the upper and bottom end of the support hook 22 around the side of the ring hole 23 is a plastic jacket 24.

When the hook 30 is hung on the ring hole 23 of the metal hanger ring 20, the contact of the hook 30 with the metal hanger ring 20 will not encounter frictional contact because of the protection of the plastic jacket 24. Because of the separation caused by the plastic jacket 24 between the hook 30 and the metal hanger ring 20, the metal between them will not be rubbed and the electroplating of the metal surface will not be destroyed directly while in use. The appearance of the metal hanger ring 20 and the hook 30 will not become rusty and deformed, but durable and esthetically pleasing.

The embodiment of the present invention described above is to be deemed in all respects as being illustrative and not restrictive. Accordingly, the present invention may be embodied in other specific forms without deviating from the spirit thereof. The present invention is therefore to be limited only by the scopes of the following appended claim.

I claim:

1. An apparatus comprising:

a hanger ring formed of an electroplated metal material, said hanger ring having an elongated hole formed at one end thereof, said elongated hole adapted to receive a strap therethrough said hanger ring having a support hook formed at an opposite end thereof, said support hook having a ring hole formed therein, said support hook having an end surface on a side of said ring hole opposite said elongated hole; and a plastic jacket extending entirely around an inner wall of ring hole and extending over no more than a portion of an inner wall of said elongated hole, said plastic jacket extending over and around said end surface, said plastic jacket being affixed to said support hook such that electroplated sides and electroplated surfaces of said hanger ring are exposed.

2. The apparatus of claim 1 further comprising:

a hook removably received within said ring hole of said hanger ring, said plastic jacket interposed between said hook and said inner wall of said ring hole.

3. The apparatus of claim 2, said plastic jacket interposed between a surface of said hook and said end surface of said hanger ring.

4. The apparatus of claim 1, said plastic jacket extending over a portion of one side and only one side of said elongated hole.

5. The apparatus of claim 1, and hanger ring having a generally triangular shape, said elongated hole having a longitudinal axis extending in generally parallel relationships with a side of said generally triangular shape, said plastic jacket extending over said end surface at a corner of said generally triangular shape opposite said side.

6. The apparatus of claim 5, said hanger ring having sides extending from said corner, said plastic jacket extending over only a portion of said slides.

* * * * *

UNITED STATES PATENT AND TRADEMARK OFFICE

CERTIFICATE OF CORRECTION

PATENT NO. : 5,937,491
DATED : August 17, 1999
INVENTOR(S) : Chih, Chen Wei

It is certified that error appears in the above-identified patent and that said Letters Patent is hereby corrected as shown below:

Title page,
After the section entitled "Filed:", insert a section entitled "Foreign Application Priority Data" as follows:

--Foreign Application Priority Data
October 30, 1997 [Taiwan] Taiwan.....86218352 --.

Signed and Sealed this

Seventh Day of August, 2001

*Attest:*

Nicholas P. Godici

*Attesting Officer*

NICHOLAS P. GODICI
*Acting Director of the United States Patent and Trademark Office*